US011692520B2

(12) United States Patent
Brown

(10) Patent No.: US 11,692,520 B2
(45) Date of Patent: Jul. 4, 2023

(54) FUEL INJECTOR INCLUDING VALVE SEAT PLATE HAVING STRESS-LIMITING GROOVE

(71) Applicant: Caterpillar Inc., Peoria, IL (US)

(72) Inventor: Cory A. Brown, Peoria, IL (US)

(73) Assignee: Caterpillar Inc., Peoria, IL (US)

( * ) Notice: Subject to any disclaimer, the term of this patent is extended or adjusted under 35 U.S.C. 154(b) by 206 days.

(21) Appl. No.: 16/990,398

(22) Filed: Aug. 11, 2020

(65) Prior Publication Data

US 2020/0370522 A1 Nov. 26, 2020

Related U.S. Application Data

(62) Division of application No. 15/684,271, filed on Aug. 23, 2017, now Pat. No. 10,781,777.

(51) Int. Cl.

| | |
|---|---|
| ***F02M 47/02*** | (2006.01) |
| ***F02M 51/06*** | (2006.01) |
| ***F02M 55/00*** | (2006.01) |
| ***F02M 61/20*** | (2006.01) |
| ***F02M 61/04*** | (2006.01) |

(52) U.S. Cl.

CPC ..... *F02M 51/0632* (2013.01); *F02M 47/027* (2013.01); *F02M 51/0628* (2013.01); *F02M 55/004* (2013.01); *F02M 55/008* (2013.01); *F02M 61/045* (2013.01); *F02M 61/20* (2013.01); *F02M 2200/28* (2013.01)

(58) Field of Classification Search

CPC ... F02M 47/027; F02M 55/008; F02M 61/045

USPC ..... 239/585.4

See application file for complete search history.

(56) References Cited

U.S. PATENT DOCUMENTS

| | | | | |
|---|---|---|---|---|
| 3,632,081 | A * | 1/1972 | Evans | F16K 31/0665 251/333 |
| 3,871,615 | A * | 3/1975 | Donner | F16K 31/0668 251/327 |
| 4,008,876 | A * | 2/1977 | Bastle | F02M 63/022 251/76 |
| 4,285,497 | A * | 8/1981 | Gottel | F16K 31/105 137/625.65 |
| 4,540,155 | A | 9/1985 | Redston | |
| 4,561,632 | A | 12/1985 | Hugler | |

(Continued)

FOREIGN PATENT DOCUMENTS

| | | | |
|---|---|---|---|
| CN | 105579699 | A | 5/2016 |
| DE | 202016002391 | U1 | 6/2016 |

(Continued)

*Primary Examiner* — Chee-Chong Lee

(74) *Attorney, Agent, or Firm* — Brannon Sowers & Cracraft PC

(57) ABSTRACT

A fuel injector includes an injector body and a valve stack within the injector body that includes a valve seat plate. The valve seat plate includes a pressure control passage for controlling fuel injection, and a valve seat positioned fluidly between the pressure control passage and a low-pressure drain. The valve seat plate includes a pressure-limiting annular groove that extends circumferentially around the valve seat and axially inward from a side of the valve seat plate where the valve seat is located. The groove enables deformation in response to pressure differences across the valve seat plate in a manner that limits stress concentrations.

10 Claims, 3 Drawing Sheets

(56) References Cited

U.S. PATENT DOCUMENTS

| | | | | |
|---|---|---|---|---|
| 4,605,197 | A | 8/1986 | Casey et al. | |
| 4,765,587 | A | 8/1988 | Cummins | |
| 4,840,193 | A | 6/1989 | Schiel | |
| 5,467,963 | A * | 11/1995 | Crofts | F02M 59/466 411/266 |
| 5,676,114 | A | 10/1997 | Tarr et al. | |
| 6,056,264 | A | 5/2000 | Benson et al. | |
| 6,286,768 | B1 | 9/2001 | Vetters et al. | |
| 6,520,144 | B2 | 2/2003 | Shiraishi et al. | |
| 6,755,353 | B2 | 6/2004 | Lorraine et al. | |
| 8,590,513 | B2 | 11/2013 | Kondo et al. | |
| 2007/0170286 | A1 | 7/2007 | Boecking | |
| 2019/0063386 | A1 | 2/2019 | Brown | |

FOREIGN PATENT DOCUMENTS

| | | | |
|---|---|---|---|
| DE | 102016004584 | B4 | 6/2018 |
| KR | 101784976 | B1 | 10/2017 |

* cited by examiner

FUEL INJECTOR INCLUDING VALVE SEAT PLATE HAVING STRESS-LIMITING GROOVE

TECHNICAL FIELD

The present disclosure relates generally to fuel systems of the type used in internal combustion engines, and more particularly to a valve seat plate for a fuel injector having an annular groove for preventing concentration of stress in a vicinity of a valve seat.

BACKGROUND

A variety of different fuel systems in internal combustion engines are well known and widely used. Aspirated fuel systems, common in older and some relatively small newer engines, suck a mixture of fuel and air into one or more engine cylinders for combustion, employing a carburetor or the like. Fuel injected systems employ a fuel injector to deliver an injection of fuel either directly into an engine cylinder where the fuel commences mixing with air, into a port fluidly connected with an engine cylinder, or upstream of the engine cylinder into an intake runner, an intake manifold, or in some instances upstream a compressor. Fuel systems of these and other forms have been used for well over a century.

In more recent years, engineers have discovered that relatively high fuel injection pressures, and rapid, yet highly precise movement and/or positioning of fuel injector components can offer various advantages relating to emissions composition, efficiency, and other engine operating and performance parameters. To operate optimally under relatively harsh conditions such as high temperatures, high and repetitive impact forces of moving parts, high-pressures, high-pressure differentials, and rapid changes in these and other variables, fuel injection system components are often machined to tight tolerances, constructed of high grade or specialized materials, or otherwise made highly robust.

It is common in certain fuel injector designs, for instance, to provide a number of precisely machined components assembled into a fuel injector body and clamped together under relatively high clamping forces to produce numerous seals and define flow paths for fuel or other actuating fluids within the fuel injector. U.S. Pat. No. 8,690,075 provides a valve seat apparently structured, among other things, for reduced force for sealing pressure with reduced valve seat to valve contact area. While the '075 patent and other designs have proven successful at least in certain environments, there is always room for improvement and/or alternative strategies.

SUMMARY OF THE INVENTION

In one aspect, a fuel injector includes an injector body defining a high-pressure passage and a low-pressure drain, and including a nozzle body defining a nozzle chamber and a plurality of nozzle outlets from the nozzle chamber. The fuel injector further includes a valve stack positioned within the injector body, and including a valve seat plate defining a nozzle supply passage fluidly connecting the high-pressure passage to the nozzle chamber, a pressure control passage, and a valve seat positioned fluidly between the pressure control passage and the low-pressure drain. The fuel injector further includes a nozzle outlet check having a closing hydraulic surface exposed to a fluid pressure of the pressure control passage. The fuel injector also includes an injection control valve assembly positioned within the injector body and including an electrical valve actuator, and an injection control valve. The injection control valve is in a closed position in contact with the valve seat, and movable from the closed position to an open position by varying an electrical energy state of the electrical valve actuator. The valve seat plate has a first side exposed to a fluid pressure of the low-pressure drain and a second side exposed to a fluid pressure of the nozzle chamber. The valve seat is formed on the first side of the valve seat plate. The valve seat plate further defines a center axis, and has formed therein an annular groove located radially inward of the nozzle supply passage, and extending circumferentially around the valve seat and axially inward from the first side of the valve seat plate.

In another aspect, a valve seat plate for a fuel injector in an internal combustion engine includes a disc-shaped body defining a center axis and having an outer peripheral surface extending between a first side of the disc-shaped body and a second side of the disc-shaped body. The disc-shaped body defines a nozzle supply passage structured to fluidly connect a high-pressure passage to a nozzle chamber in the fuel injector, a pressure control passage structured to fluidly connect the nozzle chamber to a low-pressure drain, and a valve seat. The valve seat is formed on the first side of the disc-shaped body and coaxially arranged with the pressure control passage to receive a valve for controlling the fluid connection between the nozzle chamber and the low-pressure drain. The disc-shaped body further has formed therein an annular groove positioned radially inward of a nozzle supply passage and extending circumferentially around the valve seat and axially inward from the first side of the disc-shaped body.

In still another aspect, a fuel system for an internal combustion engine includes a fuel supply conduit, and a fuel injector fluidly connected with the fuel supply conduit and including an injector body defining a fuel inlet, a low-pressure drain, a nozzle chamber, and a plurality of nozzle outlets from the nozzle chamber. The fuel system further includes a valve seat plate defining a pressure control passage, a nozzle supply passage, and a valve seat positioned fluidly between the pressure control passage and the low-pressure drain. The fuel injector further includes a nozzle outlet check having a closing hydraulic surface exposed to a fluid pressure of the pressure control passage, and an injection control valve assembly positioned within the injector body. The injection control valve assembly includes an electrical valve actuator, and an injection control valve movable from a closed position in contact with the valve seat to an open position by varying an electrical energy state of the electrical valve actuator. The valve seat is formed on a first side of the valve seat plate exposed to a fluid pressure of the low-pressure drain and located opposite a second side of the valve seat plate exposed to a fluid pressure of the nozzle chamber. The valve seat plate further defines a center axis, and has formed therein an annular groove extending circumferentially around the valve seat and axially inward from the first side of the valve seat plate.

DETAILED DESCRIPTION

Figure 1:
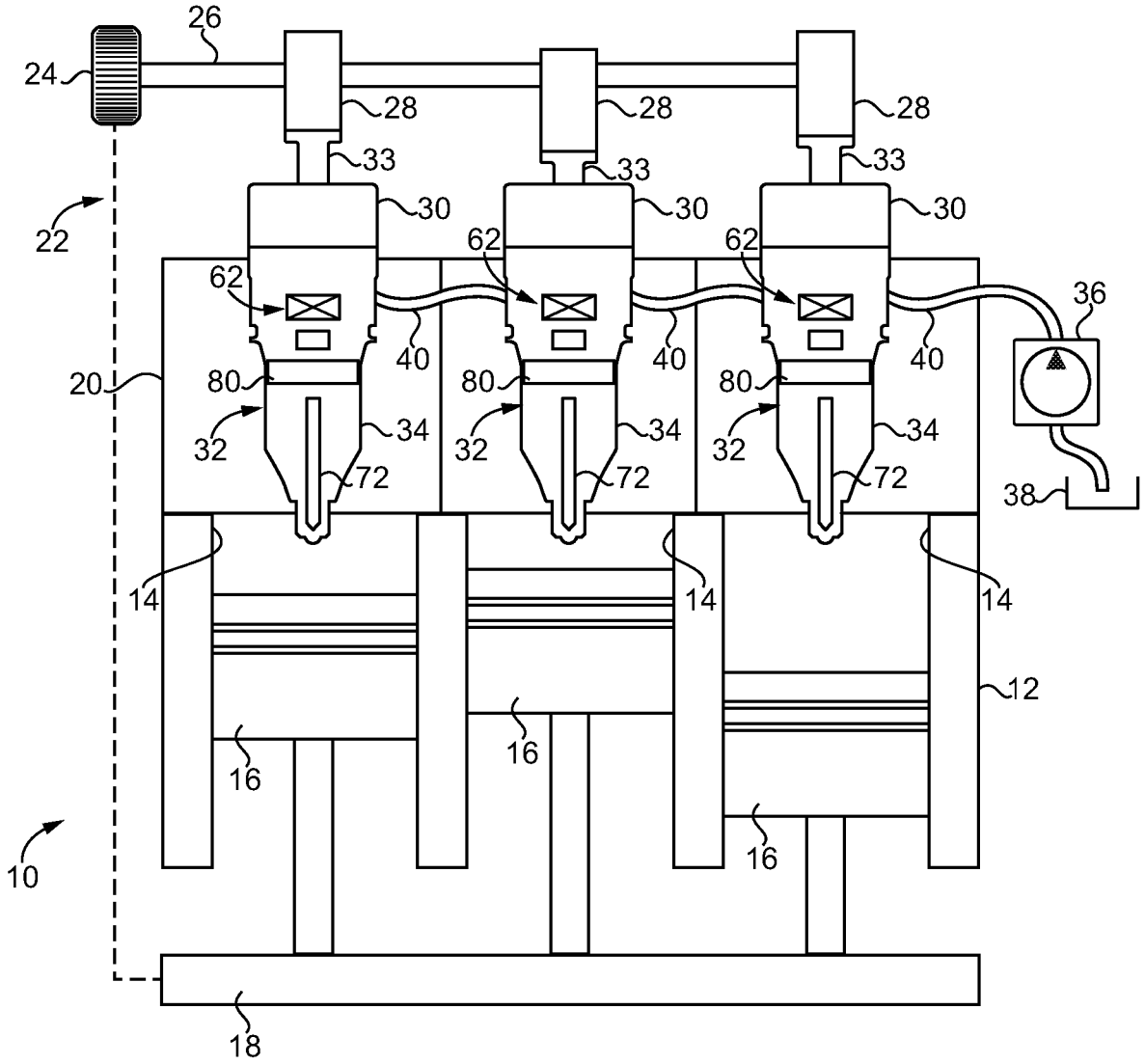
FIG. 1 is a diagrammatic view of an engine system, according to one embodiment.

Referring to FIG. 1, there is shown an engine system 10 according to one embodiment, and including an engine housing 12 having a plurality of cylinders 14 formed therein. Cylinders 14 are each equipped with a piston 16 that can be reciprocated therein in a generally conventional manner to rotate a crankshaft 18. An engine head 20 is coupled to engine housing 12 in a generally conventional manner, and will be understood to include the various and typical valves, air and exhaust conduits, gaskets, seals, and other apparatus of a modern internal combustion engine. Engine system 10 also includes a fuel system 22 having a cam gear 24 that will typically be operated by way of an engine geartrain coupled with crankshaft 18, a camshaft 26 coupled with cam gear 24 and having a plurality of cams 28 thereon, a pump 36 and a fuel tank or fuel supply 38. A fuel supply conduit 40 fluidly connects pump 36 to a plurality of fuel injectors 32 mounted within engine head 20 and each extending into a corresponding one of cylinders 14. In the illustrated embodiment, engine system 10 is a direct injected internal combustion engine, and will typically include a compression ignition diesel engine, however, the present disclosure is not thereby limited. Each of fuel injectors 32 may be coupled directly or indirectly with a pump 30 including a tappet 33 that is operated by one of cams 28. Embodiments are contemplated where only some of the fuel injectors in fuel system 22 are equipped with a pump. Embodiments are also contemplated where no pumps directly associated with each individual fuel injector are used at all. In such an embodiment fuel supply conduit 40 could be a so-called common rail or the like, and pump 36 or a plurality of pumps could be structured to convey fuel from fuel tank 38 to fuel conduit 40 at a pressure already high enough for injection. It is nevertheless contemplated that a unit pump design as is shown in FIG. 1 provides a practical implementation strategy. Each of fuel injectors 32 also includes a plurality of internal components that can be used for initiating and terminating fuel injection. As will be further apparent from the following description, internal components of each fuel injector 32, namely, a valve seat plate 80, can be structured for limiting stress concentrations that might otherwise lead to performance degradation or other problems.

Figure 2:
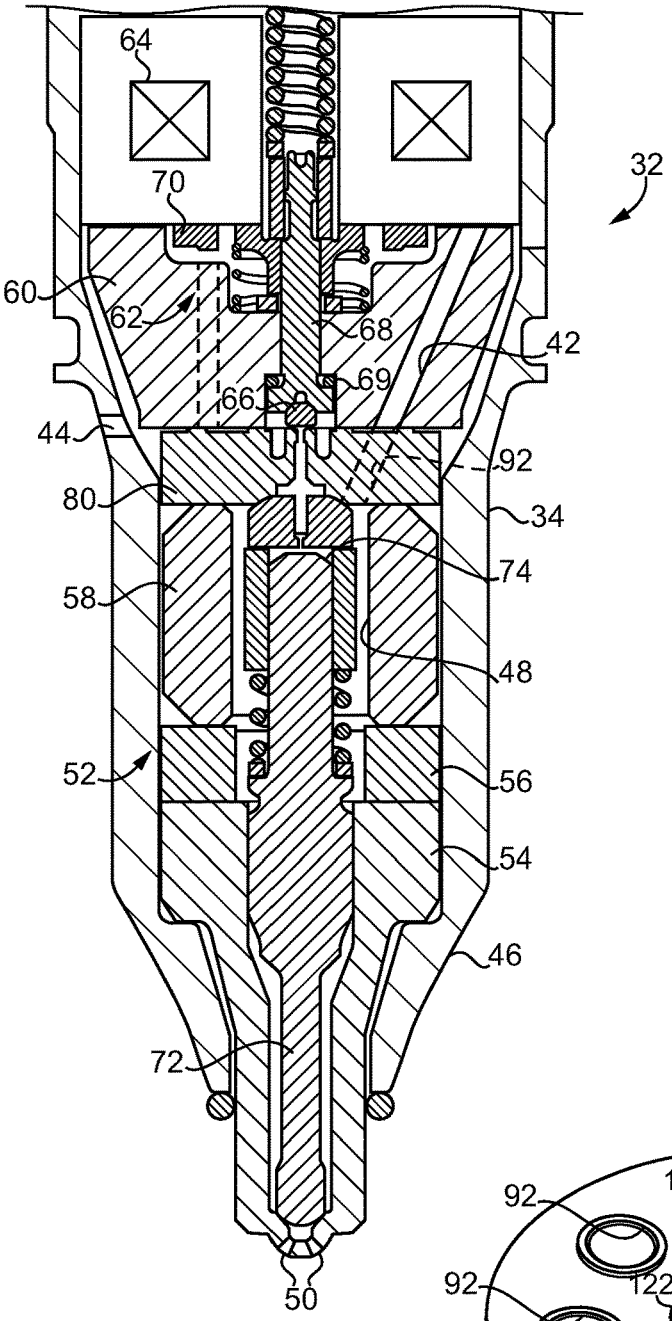
FIG. 2 is a sectioned side diagrammatic view of a fuel injector, according to one embodiment.

Referring also now to FIG. 2, there are shown certain components of an exemplary fuel injector 32 in further detail. It will be appreciated the description herein of any one of fuel injectors 32 in the singular, or any one of its individual components, can be understood to refer analogously to the other fuel injectors 32 and their respective components. Fuel injector 32 includes an injector body 34 defining a high-pressure passage 42 and a low-pressure drain 44. In an implementation high-pressure passage 42 can be supplied with pressurized fuel having been pressurized by way of the operation of the corresponding one of pumps 30 and tappets 33. Low-pressure drain 44 can include a drain connecting an internal volume of injector body 34 with a drain conduit (not shown) that leads back to fuel tank 38, for example. The precise positioning of low-pressure drain 44, high-pressure passage 42, and certain other components of fuel injector 32 could be modified from the illustrated embodiments without departing from the scope of the present disclosure.

Injector body 34 further includes a nozzle body 46 defining a nozzle chamber 48 and a plurality of nozzle outlets 50 from nozzle chamber 48, and structured to fluidly connect nozzle chamber 48 with a corresponding one of cylinders 14. Fuel injector 32 also includes a valve stack 52 (hereafter stack 52) positioned within injector body 34. Stack 52 can include components within nozzle body 46 and injector body 34 generally, including a tip piece 54, a spacer 56, another spacer 58, a control valve piece 60, and also valve seat plate 80 sandwiched between piece 60 and spacer 58.

Figure 3:
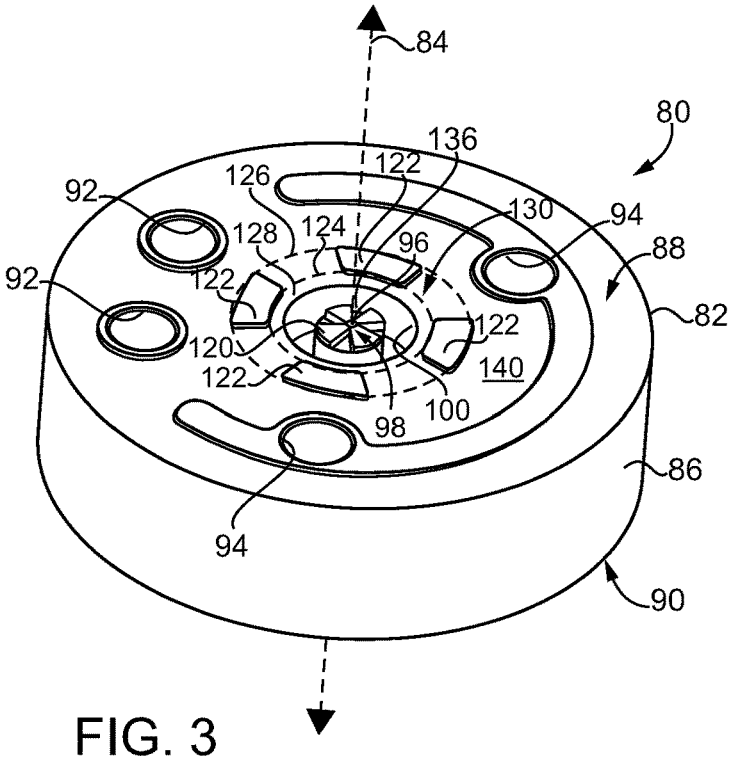
FIG. 3 is a perspective view of a valve seat plate, according to one embodiment.

Fuel injector 32 further includes an injection control valve assembly 62 positioned within injector body 34 and having an electrical valve actuator 64, such as a solenoid, and an injection control valve 66. Injection control valve 66 may be contacted by a rod 68 coupled with an armature 70. The design and operation of injection control valve assembly 62 can be generally of a known strategy. Referring also now to FIG. 3, there is shown a diagrammatic view, in perspective, of valve seat plate 80. Injection control valve 66 can include a flat-sided valve, a ball valve, or still another design positioned in a closed position at rest in contact with a valve seat 98. Valve seat 98 may be part of valve seat plate 80 as further discussed herein. Valve seat plate 80 may include a disc-shaped body 82 having an outer peripheral surface 86 extending circumferentially around a center axis 84 defined by disc-shaped body 82. It should be appreciated that features herein may be described as being part of valve seat plate 80 or part of disc-shaped body 82. No limitation is intended by way of reference of any one feature to disc-shaped body 82 versus valve seat plate 80, and those terms are used interchangeably. Outer peripheral surface 86 may be substantially cylindrical in shape. First side 88 may include a variety of sealing features for sealing between valve seat plate 80 and piece 60, whereas second side 90 could be substantially uniform although the present disclosure is not thereby limited. Valve seat plate 80 defines a nozzle supply passage 92 fluidly connecting high-pressure passage 42 to nozzle chamber 48. Valve seat plate 80 can further include dowel holes 94 structured to receive dowels for locating valve seat plate 80 in fuel injector 32. In an implementation, two nozzle supply passages 92 could be provided as shown in FIG. 3. Valve seat plate 80 further includes a pressure control passage 96, and valve seat 98 is positioned fluidly between pressure control passage 96 and low-pressure drain 44. In an implementation injection control valve 66 is in a closed position as noted above, in contact with valve seat 98, and is movable from the closed position to an open position by varying an electrical energy state of electrical valve actuator 64. A biasing spring 69 may bias valve 66 toward the closed position. In some embodiments electrical valve actuator 64 could be energized or its energy state increased to initiate fuel injection and de-energized or its electrical energy state decreased to end fuel injection. A strategy that is generally the opposite with respect to energizing or de-energizing could instead be employed depending upon the design of injection control valve assembly 62.

Fuel injector 32 can further include a nozzle outlet check 72 having a closing hydraulic surface 74 exposed to a fluid pressure of pressure control passage 96. First side 88 is exposed at least in part to a fluid pressure of low-pressure drain 44, whereas second side 90 is exposed at least in part to a fluid pressure of nozzle chamber 48. It will therefore be appreciated that moving injection control valve 66 from a closed position blocking valve seat 98 to an open position can connect pressure control passage 96 to low-pressure, enabling high-pressure in nozzle chamber 48 to act on opening hydraulic surfaces (not labeled) of nozzle outlet check 72 to cause nozzle outlet check 72 to fluidly connect nozzle outlets 50 with nozzle chamber 48. Relieving the closing hydraulic pressure on closing hydraulic surface 74 in this manner can therefore initiate a fuel injection event. Closing fuel injection control valve 66 to block valve seat 98 can enable closing hydraulic pressure to be restored to closing hydraulic surface 74 and terminate a fuel injection event.

Figure 4:
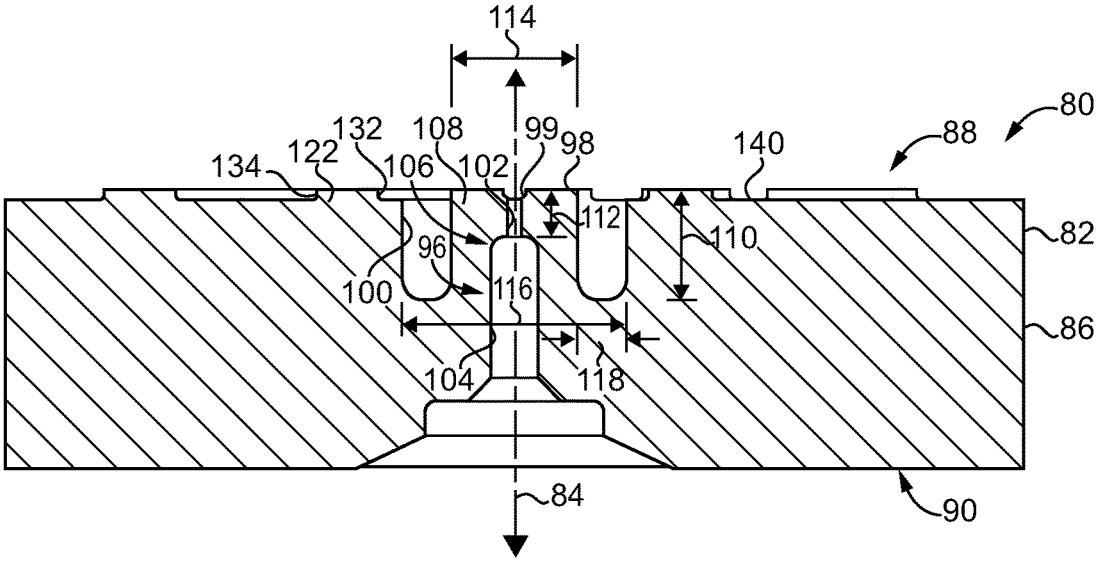
FIG. 4 is a sectioned side diagrammatic view of the valve seat plate of FIG. 3, according to one embodiment.

Valve seat plate 80 further has formed therein a stress-limiting annular groove 100 located radially inward of nozzle supply passage 92 and extending circumferentially around valve seat 98, and axially inward from first side 88 of valve seat plate 80. Referring now also to FIG. 4, pressure control passage 96 may be formed by a first bore 102 that extends axially inward from first side 88, and a counterbore 104 that extends axially inward from second side 90. First bore 102 intersects counterbore 104 at an intersection 106 that is closer to first side 88 than to second side 90 in the illustrated embodiment. Another counterbore 99 may be formed on first side 88. Also in the illustrated embodiment an axial depth 110 of stress-limiting annular groove 100 (hereinafter "groove 100") from first side 88 is greater than an axial depth 112 of intersection 106 from first side 88. It can be seen that axial depth 110 is about twice axial depth 112, or greater. It should be appreciated that axial depth 110 could exceed axial depth 112 by a relatively lesser amount, such as 10%, 25%, or 50% greater, for instance. Axial depth 110 might also exceed axial depth 112 by a greater factor, for instance a factor of about 2.5 or 3. It can also be seen from the illustrations that valve seat plate 80 include a central island 108 that is formed by groove 100, and that valve seat 98 is located in central island 108. FIG. 4 also identifies additional proportional and dimensional attributes of valve seat plate 80, including an outer diameter dimension 114 of central island 108, a radial thickness 118 of groove 100, and an outer diameter dimension 116 of groove 100. In an implementation, outer diameter dimension 116 may be about two times outer diameter dimension 114. Axial depth 110 may be about half outer diameter dimension 116 or greater.

Valve seat plate 80 also includes a raised sealing surface 120 that forms valve seat 98. In the illustrated embodiment, raised sealing surface 120 includes a plurality of evenly spaced radially outward extending arms 136. Arms 136 may be regularly spaced from one another, and extend radially outward to terminate at a radially outward edge (not numbered) of central island 108. Also identified in FIG. 4 are a plurality of additional raised sealing surfaces 122 that are positioned radially outward of groove 100. A number of raised sealing surfaces 122 can be four as in the illustrated embodiment, each of which is circumferentially aligned with one of arms 136. In alternative embodiments raised sealing surfaces 122 might be different in number, including three, five, six, or another number. Flow channels 130 upon a land surface 140 of first side 88 are formed between raised sealing surfaces 122. A circumferential extent of each one of sealing surfaces 122 might be about 45 degrees, however, the present disclosure is again not limited in this regard and the circumferential extent could vary depending upon desired flow requirements, or other factors, from valve seat 98 to low-pressure drain 44. Each of raised sealing surfaces 122 also includes a leading edge 132 as shown in FIG. 4, and a trailing edge 134. Each of leading edges 132 may be located on an inner circle 124 that is centered upon and extends circumferentially about center axis 84, whereas each trailing edge 134 may be located on an outer circle 126 that is also positioned radially outward of groove 100 and extends circumferentially around center axis 84. A stand-back zone 128 extends radially between each leading edge 132 and annular groove 100.

INDUSTRIAL APPLICABILITY

As discussed above, a high fluid pressure may be resident at least some of the time in nozzle chamber 48, relative to a pressure of low-pressure drain 44, which could be at atmospheric pressure. The pressure in nozzle chamber 48 that can be communicated to second side 90 of valve seat plate 80 can be in the hundreds of megaPascals (mPa). The pressure difference across valve seat plate 80 can cause valve seat plate 80 to bulge by at least a few microns upwardly, potentially causing concentrations of stress that could lead to cracking, seal failure or leakage, or other problems. While one solution could perhaps be to make a valve seat plate in such circumstances thicker, for various reasons a valve seat plate is desirably lower profile to avoid injector packaging issues. It will be noted that valve seat plate 80 is several times wider than it is thick in an axial direction. Stress-limiting annular groove 100 enables valve seat plate 80 to flex in a manner that avoids stress concentrations in areas that could be problematic either because such areas would be considered sensitive to stress concentration or because the stress concentrations would be relatively extreme.

Figure 5:
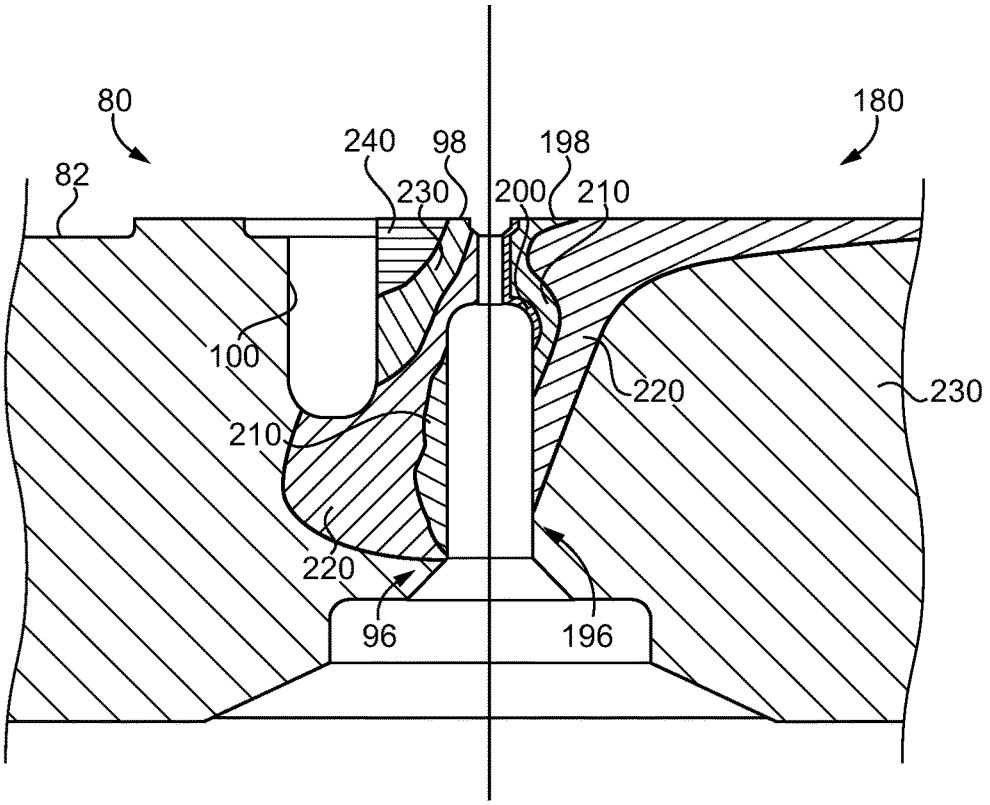
FIG. 5 is a partial sectioned side diagrammatic view with a first side of FIG. 5 illustrating stress concentration properties in a valve seat plate according to the present disclosure, in comparison to a second side of FIG. 5 where stress concentration properties are shown in a valve seat plate of another design.

Referring now to FIG. 5, there is shown an illustration where the left half of the drawing illustrates stress concentration properties that might be observed in a valve seat plate 80 according to the present disclosure, in comparison with a valve seat plate 180 of another design including a pressure control passage 196 and a valve seat 198 on the right half of the illustration. Different zones of stress magnitude are shown with different sectioning. On the right side of FIG. 5, in the design formed without a stress-limiting annular groove, it can be seen that a high stress level 200 might be observed at or near an intersection of bores forming pressure control passage 196. A relatively lesser stress magnitude 210 might be observed radially outward and axially upward, whereas still another, lesser stress magnitude 220 might be observed also radially outward and axially upward, followed by a still lesser stress magnitude 230 mostly radially outward.

In the valve seat plate 80 according to the present disclosure, however, different stress properties are likely to be observed. The highest stress magnitude 210 is less than the highest stress magnitude 200 seen in the alternative design and is observed substantially lower down in pressure control passage 96 as compared to the highest stress magnitude 200 in the alternative design. A lesser stress magnitude level 220 might be observed radially outward, with lesser stress levels 230 and 240 also observed at generally progressively radially outward locations. It can also be noted that the overall stress magnitudes observed at least in the general vicinity of pressure control passage 96 are less in valve seat plate 80 than in the alternative design. In accordance with the present disclosure, where high stress magnitudes are observed, they are expected to occur in areas where problems are less likely to develop, at least in comparison to the locations of stress concentration and the stress magnitudes in the alternative design. In valve seat plate 80, to the extent stress concentrations are observed at all, they can be expected to occur axially lower than in valve seat plate 180, away from tightly radiused surfaces that are multi-dimensionally radiused or areas of less material thickness generally. Although the actual deformation or deflection may be relatively minute, stress-limiting annular groove 100 can thus provide sufficient relief that improved performance can be expected over the course of the thousands of hours of fuel injector service life.

The present description is for illustrative purposes only, and should not be construed to narrow the breadth of the present disclosure in any way. Thus, those skilled in the art will appreciate that various modifications might be made to the presently disclosed embodiments without departing from the full and fair scope and spirit of the present disclosure. Other aspects, features and advantages will be apparent upon an examination of the attached drawings and appended claims. As used herein, the articles "a" and "an" are intended to include one or more items, and may be used interchangeably with "one or more." Where only one item is intended, the term "one" or similar language is used. Also, as used herein, the terms "has," "have," "having," or the like are intended to be open-ended terms. Further, the phrase "based on" is intended to mean "based, at least in part, on" unless explicitly stated otherwise.

What is claimed is:

1. A valve seat plate for a fuel injector comprising:

a disc-shaped body defining a center axis and having an outer peripheral surface extending circumferentially around the center axis and axially between a first side and a second side of the disc-shaped body;

the disc-shaped body defining a nozzle supply passage and a pressure control passage each extending through the disc-shaped body between the first side and the second side;

a valve seat is formed on the first side of the disc-shaped body and is fluidly connected to the pressure control passage;

a stress-limiting groove is formed in the first side and extends circumferentially around the valve seat at a location radially outward of the valve seat and radially inward of the nozzle supply passage;

the stress-limiting groove including a radially inward groove surface defining a first circle having a constant curvature 360 degrees around the center axis, and a radially outward groove surface defining a second circle having a constant curvature 360 degrees around the center axis; and the disc-shaped body further including an end surface upon the first side oriented normal to the center axis and extending from the stress-limiting groove to the outer peripheral surface.

2. The valve seat plate of claim 1 further comprising:

a plurality of raised sealing surfaces formed on the upper side of the disc-shaped body and having a circumferential distribution around the center axis; and a plurality of flow channels formed on the upper side and having an alternating arrangement with the plurality of raised sealing surfaces.

3. The valve seat plate of claim 2 wherein the plurality of raised sealing surfaces each include a leading edge, and the leading edges are located upon a common circle centered on the center axis.

4. The valve seat plate of claim 1 wherein:

the pressure control passage is formed by a bore extending axially inward from the first side, and a second bore extending axially inward from the second side;

an intersection is defined by the bore and the second bore; and the stress-limiting groove extends axially inward from the first side to an axial depth that is axially between the intersection and the second side of the disc-shaped body.

5. The valve seat plate of claim 4 wherein the annular groove defines an outer diameter dimension, and the axial depth is equal to at least one-half of the outer diameter dimension.

6. The valve seat plate of claim 1 further comprising a central island, and the stress-limiting groove extends circumferentially around the central island and the valve seat is located on the central island.

7. A valve seat plate for a fuel injector comprising:

a disc-shaped body defining a center axis and having an outer peripheral surface extending circumferentially around the center axis, and axially between a first side of the disc-shaped body having an axial end surface, and a second side of the disc-shaped body;

the disc-shaped body defining a nozzle supply passage and a pressure control passage each extending through the disc-shaped body between the first side and the second side;

a valve seat formed in the first side and fluidly connected to the pressure control passage, and the center axis extends through the valve seat;

a first set of sealing surfaces raised relative to the axial end surface and distributed circumferentially around the valve seat at a location that is radially inward;

a second set of sealing surfaces raised relative to the axial end surface, and distributed circumferentially around the center axis at a location that is radially outward of the first set of sealing surface and spaced radially inward of the outer peripheral surface;

the first set of sealing surfaces and the second set of sealing surfaces each defining a flat plane, and the two flat planes being positioned coplanar within a common flat plane; and a stress-limiting groove formed in the first side and extending circumferentially around the valve seat at a location that is radially between the first set of sealing surfaces and the second set of sealing surfaces.

8. The valve seat plate of claim 7 wherein a stand-back zone extends radially between the stress-limiting groove and the second set of sealing surfaces.

9. The valve seat plate of claim 7 wherein a distribution of the second set of sealing surfaces circumferentially around the center axis is radially symmetric, and a plurality of flow channels are formed between adjacent ones of the second set of sealing surfaces.

10. The valve seat plate of claim 7 wherein the disc-shaped body includes a central island, and the valve seat and the first set of sealing surfaces are located on the central island.

* * * * *